US006520351B1

(12) United States Patent
Zadro

(10) Patent No.: US 6,520,351 B1
(45) Date of Patent: Feb. 18, 2003

(54) REVERSIBLE SHOWER CADDY

(76) Inventor: Zlatko Zadro, 5332 System Dr., Huntington Beach, CA (US) 92649

( * ) Notice: Subject to any disclaimer, the term of this patent is extended or adjusted under 35 U.S.C. 154(b) by 0 days.

(21) Appl. No.: 09/694,907

(22) Filed: Oct. 24, 2000

(51) Int. Cl.[7] ..... A47F 5/00

(52) U.S. Cl. ..... 211/119; 211/117; 211/118; 211/106; D6/525

(58) Field of Search ..... 211/113, 119, 211/106, 118, 85.31, 117; D6/525

(56) References Cited

U.S. PATENT DOCUMENTS

| | | | | | |
|---|---|---|---|---|---|
| 3,391,891 | A | * | 7/1968 | Garden | |
| D251,999 | S | * | 6/1979 | Bautista | |
| 4,398,309 | A | * | 8/1983 | Simons | |
| D315,840 | S | * | 4/1991 | Emery | D6/525 |
| D335,232 | S | * | 5/1993 | Whitlock | D6/525 |
| D349,205 | S | * | 8/1994 | Khuhawar | D6/525 |
| D367,790 | S | * | 3/1996 | Munoz et al. | D6/525 |
| D368,128 | S | * | 3/1996 | McCarthy | D6/525 X |
| D396,585 | S | * | 8/1998 | Hofman | D6/525 |
| D400,745 | S | * | 11/1998 | France | D6/525 |
| D409,424 | S | * | 5/1999 | Hofman et al. | D6/525 |
| 6,241,388 | B1 | * | 6/2001 | Teramani | |

* cited by examiner

*Primary Examiner*—Robert W. Gibson, Jr.
(74) *Attorney, Agent, or Firm*—William L. Chapin

(57) ABSTRACT

A shower caddy for holding personal care articles customarily used in bathroom showers which is reversible to enable the caddy to alternatively be attached to a shower head and shower enclosure panel includes a pair of laterally spaced apart, straight vertical stanchion rods, each having at the upper end thereof a short upper end arm which protrudes perpendicularly forward from a longer lower portion of the stanchion. An upper transverse bracket member removably attachable at outer lateral ends thereof to the stanchions has a laterally centrally located central arch section having an upwardly concave opening adapted to fit over a shower pipe and thereby suspend the caddy frame therefrom. The reversible shower caddy includes a plurality of article storage shelves which are removably attached to the stanchions at adjustable heights, the shelves protruding perpendicularly forward from the stanchions when the caddy is hung from a shower head. A pair of laterally opposed hooks protruding forward from the stanchions each has an outer portion angled downwardly and rearwardly towards a stanchion, forming therebetween an upwardly facing opening for receiving the upper edge of a shower enclosure panel or door. With shelves removed from the front sides of the stanchions and re-attached to the rear sides thereof, the caddy may be positioned with the openings of the hooks above the upper edge wall of a shower enclosure panel or do thereby enabling the panels to be insertably received within the openings of the hooks, and thereby suspending the caddy on the panel.

16 Claims, 9 Drawing Sheets

2/9
87R
32R
42R
E
40R
41R
38R
112
111
110
113
114
22R
97R
87L
32L
42L
40L
41L
38L
22L
27
97L
28
26
D

REVERSIBLE SHOWER CADDY

BACKGROUND OF THE INVENTION

A. Field of the Invention

The present invention relates to holders for accessories used in bathroom shower enclosures. More particularly, the invention relates to an improved shower caddy of the type used to hold various items typically used during showering, the improved caddy being reversible to facilitate its attachment to a shower head in one configuration, or to a shower enclosure panel or door, in a reversed configuration.

B. Description of Background Art

In addition to bar soap or liquid soap and wash cloths customarily used by people in bathroom showers, a variety of other articles related to personal hygiene are frequently used when showering. Such articles include containers of shampoo and hair conditioner, lotions, shavers, shaving cream, combs, brushes, and the like. While some shower enclosures are provided with one or more small shelves or ledges on which such personal hygiene items may be placed, many shower enclosure are devoid of any convenient location of adequate size for storing such items. Moreover, the shelves or ledges provided in typical shower enclosures tend to be relatively small, thereby affording insufficient space for storing articles without the likelihood of the articles being accidentally dislodged and falling to the floor of the shower enclosure.

In recognition of the need for providing primary or additional storage space for articles of personal hygiene used in showers, a wide variety of holders or "shower caddies" for storing such accessory articles have been disclosed and marketed. One type of shower caddy currently available is so constructed as to be readily attached to a shower head, by hanging the caddy on the inner pipe portion of the head, for example. Another type of shower caddy presently in use is provided with a hook which permits the caddy to be hung on the outer enclosure panel or door of a shower enclosure. However, the present inventor is unaware of any existing shower caddy which may be readily re-configured to enable the caddy to be attached to either a shower head or enclosure panel. The unavailability of any existing shower caddy with such a dual attachment capability was a motivating factor for the present invention.

OBJECTS OF THE INVENTION

An object of the present invention is to provide a shower caddy for storing various articles related to personal hygiene which are typically used by a person when showering, the shower caddy being reversibly attachable to a shower arm or shower enclosure panel.

Another object of the invention is to provide a reversible shower caddy including a frame provided with a transversely disposed upper bracket member adapted to attachment to a shower head, and a pair of curved engagement members which protrude outwardly from opposite sides of the upper end of the frame, the engagement members having lower portions which angle downwardly and rearwardly towards respective vertical side frame members to form therebetween openings enabling the frame to be reversed and hung on a shower enclosure panel.

Another object of the invention is to provide a shower caddy provided with a pair of laterally spaced apart, elongated vertical frame members or stanchions, a bracket member disposed laterally between the stanchions near the upper ends thereof and adapted to attachment to a shower head, a pair of laterally opposed, parallel hooks which protrude outwardly or forward from upper ends of the stanchions, each hook having a lower portion angled downwardly and rearwardly towards a front surface of stanchion, defining therebetween a pair of openings adapted to insertably receive the upper horizontal edge of a shower enclosure panel, and thereby enabling the frame to be reversed and hung on the upper horizontal edge of the enclosure panel, and a plurality of vertically spaced apart removable shelves for storing shower articles disposed between the stanchions, the shelves being attachable to the front of the frame, when the caddy is hung from a shower head, and to the rear of the frame, for hanging the caddy on a shower enclosure panel.

Another object of the invention is to provide a reversible shower caddy including a pair of elongated vertically disposed, laterally spaced apart stanchion rods having perpendicular outwardly or forwardly protruding upper arms, a transverse bracket or hanger rod removably attachable to upper ends of the stanchion rods, the hanger rod having a vertical upwardly arched portion adapted to fit downwardly over a shower head pipe, a pair of hooks each having an upper straight portion releasably and adjustably attachable to the outwardly protruding upper arms of the stanchion rods, each hook having a downwardly depending intermediate; portion and a downwardly and rearwardly angled lower portion terminating at the lower end thereof by an outwardly or forwardly curved hook portion, the hook having an inner or rearwardly directed, arcuately curved convex portion spaced forward from a stanchion member at an adjustable distance to thereby form an opening for receiving the upper edge portion of a shower enclosure panel, and a plurality of shelves removably attachable near opposite lateral sides thereof on the stanchion rods at adjustable heights, to the front of the frame when hanging the caddy on a shower head, and to the rear of the frame when hanging the caddy on a shower enclosure panel.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends an improved, reversible shower caddy for conveniently holding items typically used in a bathroom shower, e.g., wash cloths, shavers, combs, brushes, soap, and containers for shampoos, conditioners and other such preparations.

A reversible shower caddy according to the present invention includes a pair of elongated, straight, vertical side frame members, or stanchions, each having a short upper end arm that protrudes perpendicularly outwardly or forward from a long, straight, lower portion of a stanchion. In a preferred embodiment, each side frame member is fabricated from a straight steel rod, a short upper end portion of which is bent perpendicularly outwardly from the axis of the rod.

The shower caddy according to the present invention also includes a generally straight, upper transverse bracket member which is disposed transversely between the stanchions, near the upper, outwardly angled ends thereof. The transverse bracket member includes means for attaching it to a shower head protruding from a shower wall. In a preferred embodiment, the attachment means comprises an upwardly arched central portion formed in the bracket member, the arch forming an upwardly concave opening adapted to fit over a shower pipe and thereby suspend the caddy frame.

The reversible shower caddy according to the present invention also includes at least a first and preferably a plurality of shelves removably attachable at adjustable heights alternatively to the front and rear sides of the frame stanchions, the shelves comprising lower transverse members which form with the stanchions and upper transverse frame member a rigid, four-bar frame structure.

To enable the reversible shower caddy according to the present invention to be alternatively attached to a shower enclosure panel or door, as well as to a shower head, the caddy includes a pair of hooks attached to the upper arms protruding from the frame stanchions. Each hook includes an upper, straight inner tubular portion having a bore into which a stanchion arm is telescopically receivable, and fastenable at an adjustable distance from the stanchion by a thumb screw. Each hook has an intermediate portion which protrudes perpendicularly downwards from the upper straight portion, a lower straight portion which angles downwardly and rearwardly towards the frame stanchion, and a hook-shaped end portion that has a convex rear surface spaced forward from a frame stanchion, forming therebetween an opening for receiving the upper edge of shower enclosure panel or door.

With this construction, shelves may be removed from the front side of the frame stanchions and attached to the rear sides thereof to thereby protrude from the rear side of the stanchion, rather than the front side from which the upper stanchion arms protrude, when it is desired to hang the caddy on a shower enclosure panel rather than a shower head. The caddy may then be positioned adjacent to a shower enclosure panel with the hooks facing rearward and the openings between the hooks and the stanchions positioned above the upper edge wall of the enclosure panel, whereupon the caddy is moved downwardly to allow the panel to be received upwardly into the hook opening, until the upper horizontal end portions of hooks rest on the upper edge wall of the panel, thus hanging the caddy on the panel.

DESCRIPTION OF THE PREFERRED EMBODIMENTS

FIGS. 1–11 illustrates a reversible shower caddy according to the present invention.

Figure 1:
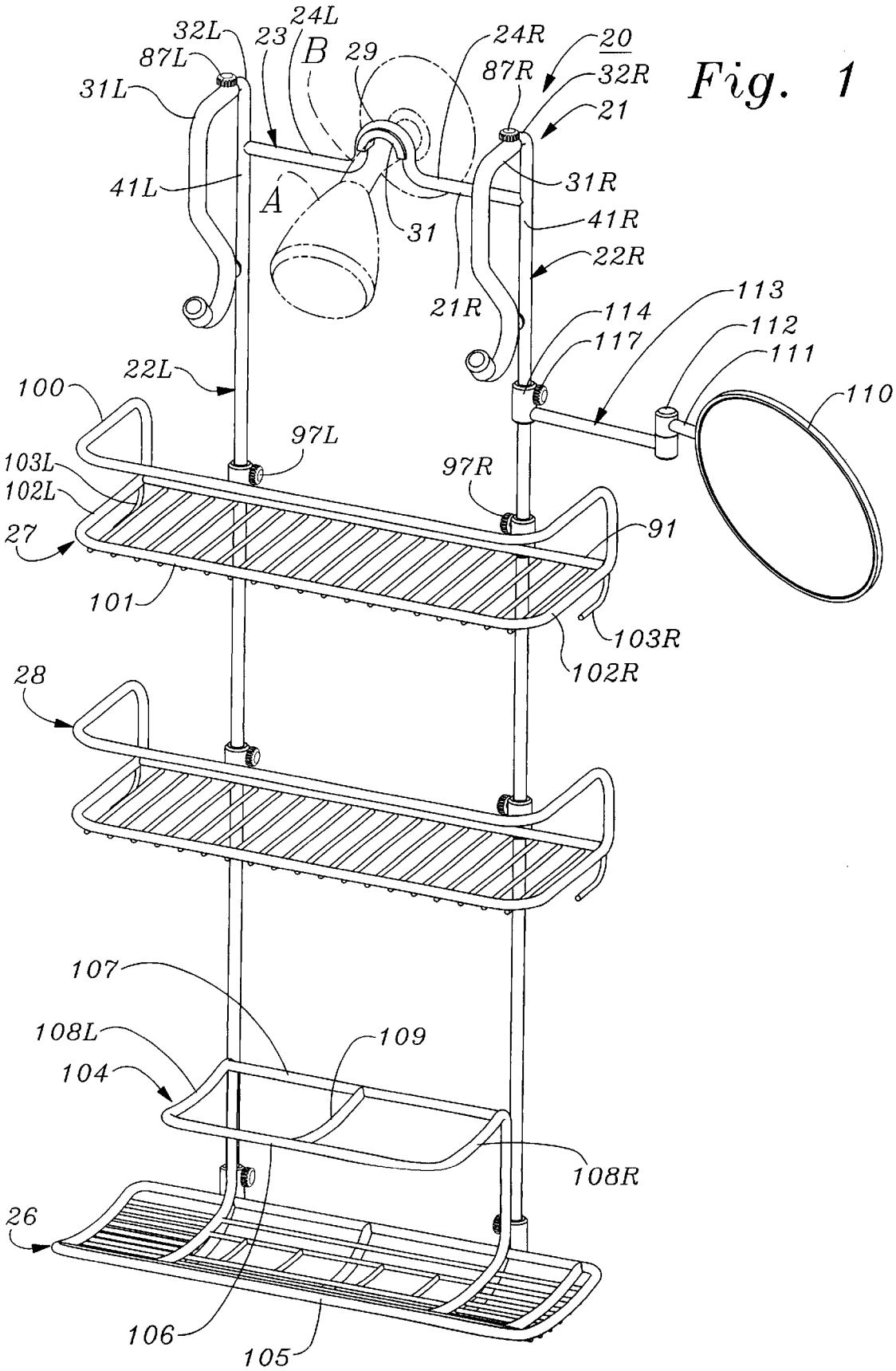
FIG. 1 is a perspective view of a reversible shower caddy according to the present invention, showing the caddy hanging on a supply pipe of a shower head.

Referring first to FIG. 1, a reversible shower caddy 20 according to the present invention may be seen to include a frame 21 comprised of two parallel, elongated straight left and right side members or stanchions 22L, 22R, and an upper transverse frame member 23 having left and right end portions 24L, 24R which protrude perpendicularly inwardly from the stanchions, near the upper ends 25 of the stanchions.

As shown in FIG. 1, reversible shower caddy 20 includes at least one shelf, e.g., a bottom shelf 26, which is disposed laterally with respect to stanchions 22, and which protrudes horizontally forward of frame 21. Preferably, as shown in FIG. 1, shower caddy 20 includes at least one upper shelf 27 disposed parallel to and above lower shelf 26, and at least an intermediate shelf 28 disposed parallel to and between the upper and lower shelves.

Referring still to FIG. 1, it may be seen that upper transverse frame member 23 has a laterally centrally located, arcuately, upwardly curved arch portion 29 joined at opposite lateral ends thereof to left and right horizontal end portions 24L, 24R of the transverse frame member. Arch section 29 has a generally semi-circular shape, and has a radius adapting the arch section to fit over the outer cylindrical surface of a shower head pipe. Thus, for example, for use with a shower head pipe having a diameter of one inch. Arch section 29 would have a radius of about ⅝ inch.

With shower caddy 20 constructed as described above, as shown in FIG. 1, the caddy may be conveniently hung onto the supply pipe B of shower head A by lifting the caddy to position arch 29 of the caddy over the water supply pipe, and allowing the force of gravity to seat the upper inner surface 30 of the arch onto the upper portion of the outer circumferential wall surface of the shower head supply pipe. However, reversible shower caddy 20 according to the present invention has additional structural elements which enable the caddy to be alternatively hung on the upper edge wall of a shower enclosure panel or door, as will now be described.

Figure 8B:
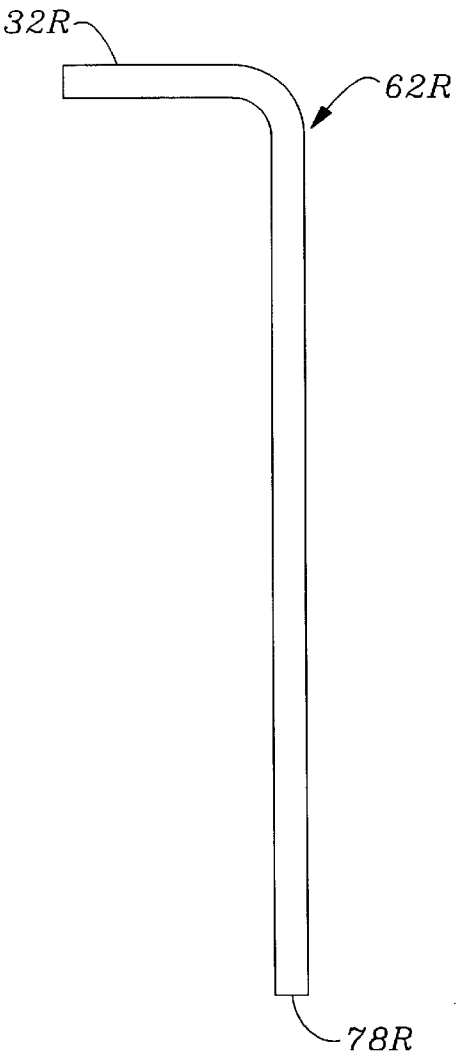
FIG. 8B is a side elevation of one of a pair of frame stanchions comprising part of the shower caddy of FIG. 3.
Figure 8A:
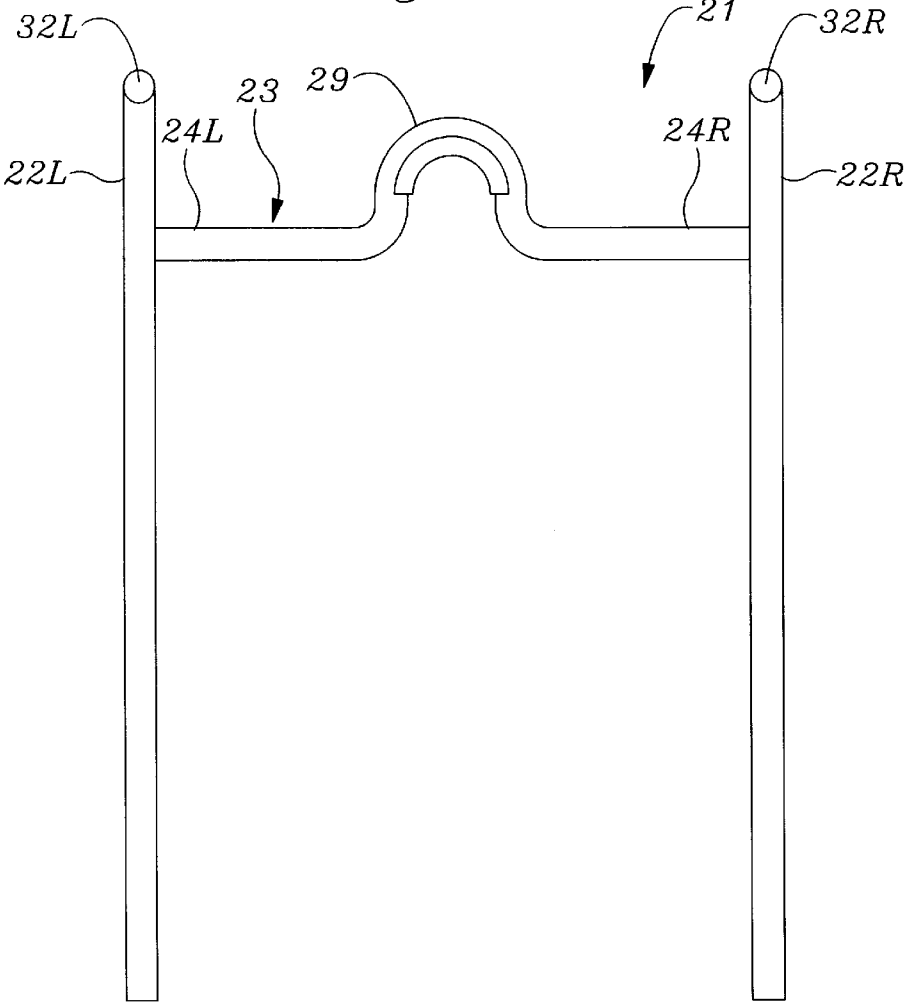
FIG. 8A is a fragmentary front elevation view of the shower caddy of FIGS. 1 and 2.

Referring now to FIG. 1, it may be seen that reversible shower caddy 20 according to the present invention includes a pair of laterally spaced apart hooks 31L, 31R which protrude forward from the upper ends of stanchions 22L, 22R. As shown in FIG. 8, in a preferred embodiment of reversible shower caddy 20, stanchions 22L, 22R are each provided near the upper end thereof with perpendicularly outward or forwardly protruding, arm 32L, 32R for a hook 31L, 31R to be attached to.

Figure 2:
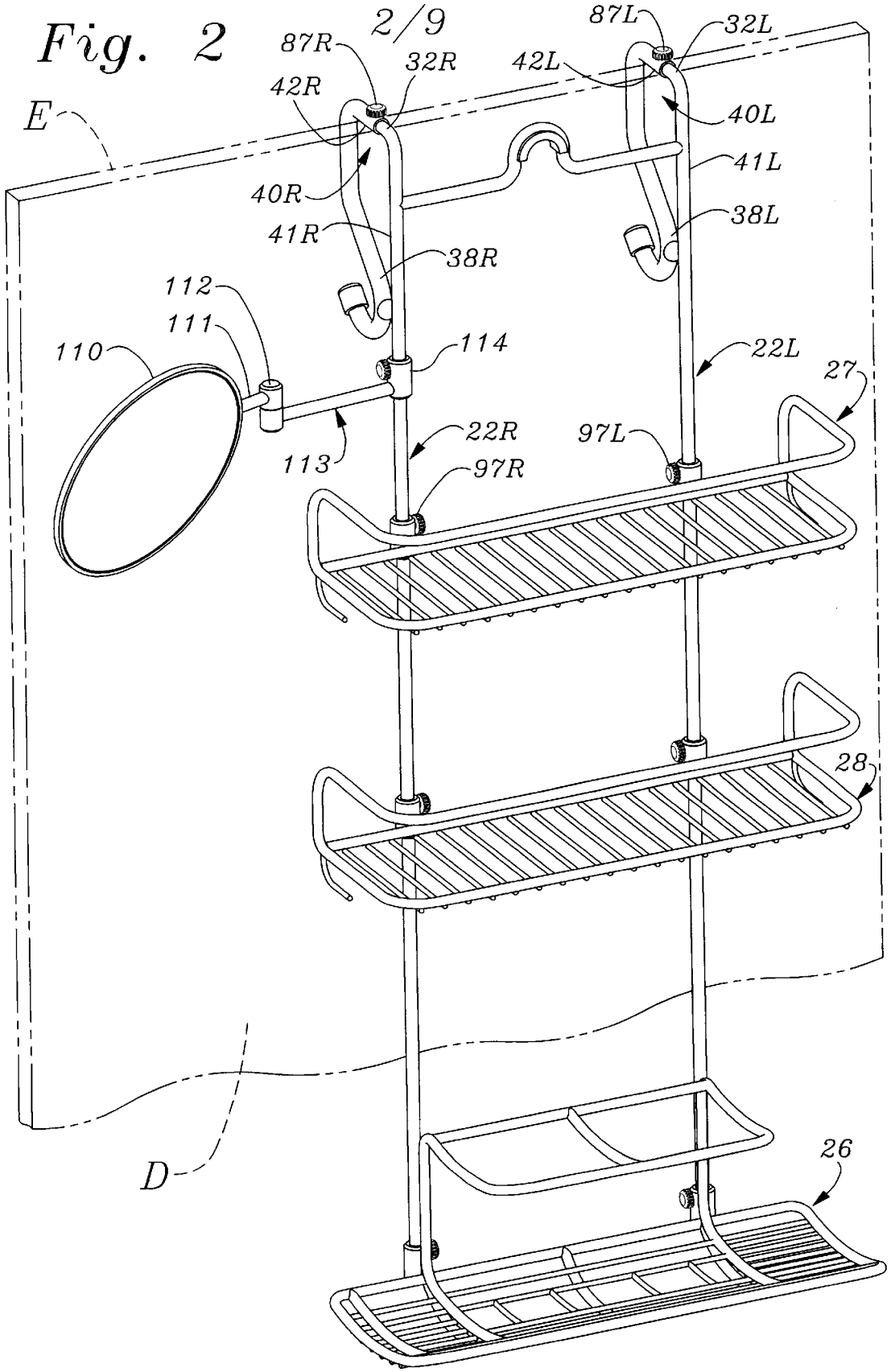
FIG. 2 is a perspective view of the reversible shower caddy of FIG. 1 in a different configuration, in which the shelves have been reversed to enable the caddy to be hung on a shower enclosure panel rather than a shower head.
Figure 9:
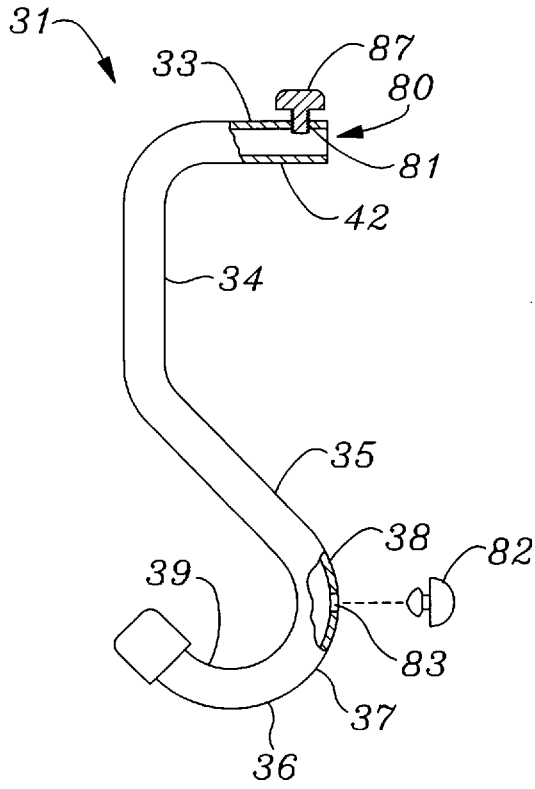
FIG. 9 is a partly sectional side elevation view of one of a pair of hooks comprising part of the shower caddies of FIGS. 2 and 3.

Referring now to FIG. 9 in addition to FIG. 2, it may be seen that each hook 31L, 31R has a generally straight upper end portion 33L, 33R collinear with a respective one of arms 32L, 32R of stanchion 22L, 22R. Each hook 31L, 31R also has an intermediate portion 34L, 34R which depends perpendicularly downwards from an outer, front end of upper end portion 33L, 33R of the hook. Also, each hook 31L, 31R has a lower straight portion 35L, 35R which angles downwardly and rearwardly towards stanchion 22L, 22R, and an arcuately curved lower end portion 36L, 36R which protrudes from a lower end of straight portion 35L, 35R. As may be seen best by referring to FIG. 9, curved lower end portion 36L, 36R of each hook 31L, 31R has in a side elevation view a shape approximating that of a semi-circle which is tangent to the longitudinal axis of angled lower straight portions 35L, 35R. Thus, lower curved portion 36L, 36R of hook 31L, 31R has a convex surface 37L, 37R including a rear vertical face 38L, 38R, which faces rearwardly towards stanchion 22L, 22R, and a curved end quadrant section 39L, 39R which protrudes downwardly from the vertical surface, thence forward and upwardly.

Hooks 31 of reversible shower caddy 20 enable the caddy to be hung on the upper edge wall of a shower enclosure panel or door. Thus, as shown in FIG. 2, shelves 26, 27, and 28 of reversible shower caddy are first detached from the front surfaces of shower caddy frame stanchions 22L, 22R, and then reattached to the rear surfaces of the frame stanchions. Next, shower caddy 20 is lifted to position openings 40L, 40R between inner vertical faces 38L, 38R of hooks 31L, 31R and the front surfaces 41L, 41R of stanchions 22L, 22R, above upper edge wall E of shower enclosure panel or door D. Reversible shower caddy 20 is then lowered with respect to the upper edge wall E of shower enclosure panel or door D, allowing the upper edge wall to be insertably received in openings 40L, 40R. When upper edge wall E of a panel D has been fully received into openings 40L, 40R, lower horizontal surfaces 42L, 42R of straight upper portions 33L, 33R of hooks 31L, 31R rest on the upper edge wall, thus supporting the shower caddy thereon.

Figure 3:
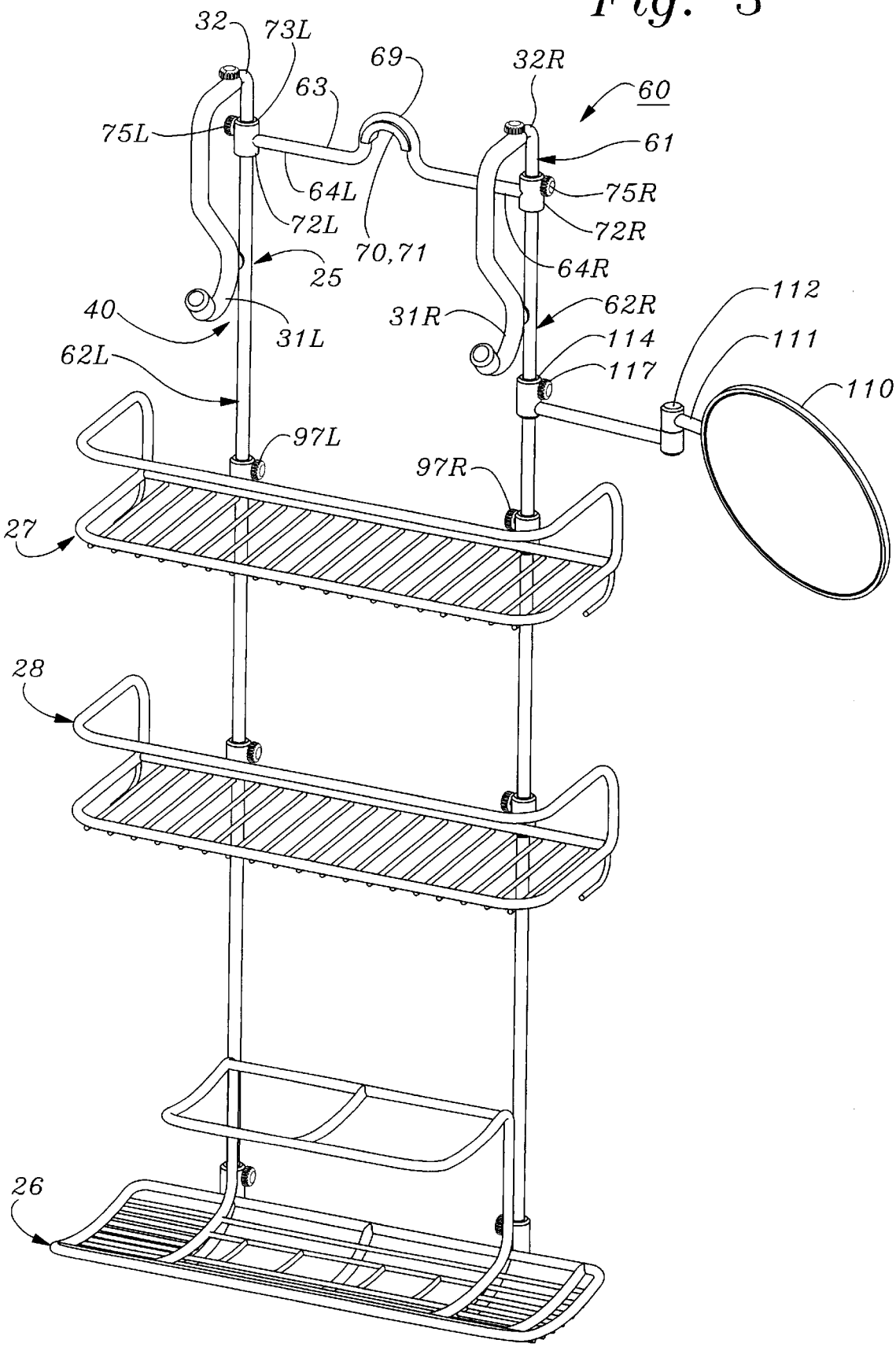
FIG. 3 is a perspective view of a modification of the shower caddy of FIGS. 1 and 2.
Figure 4:
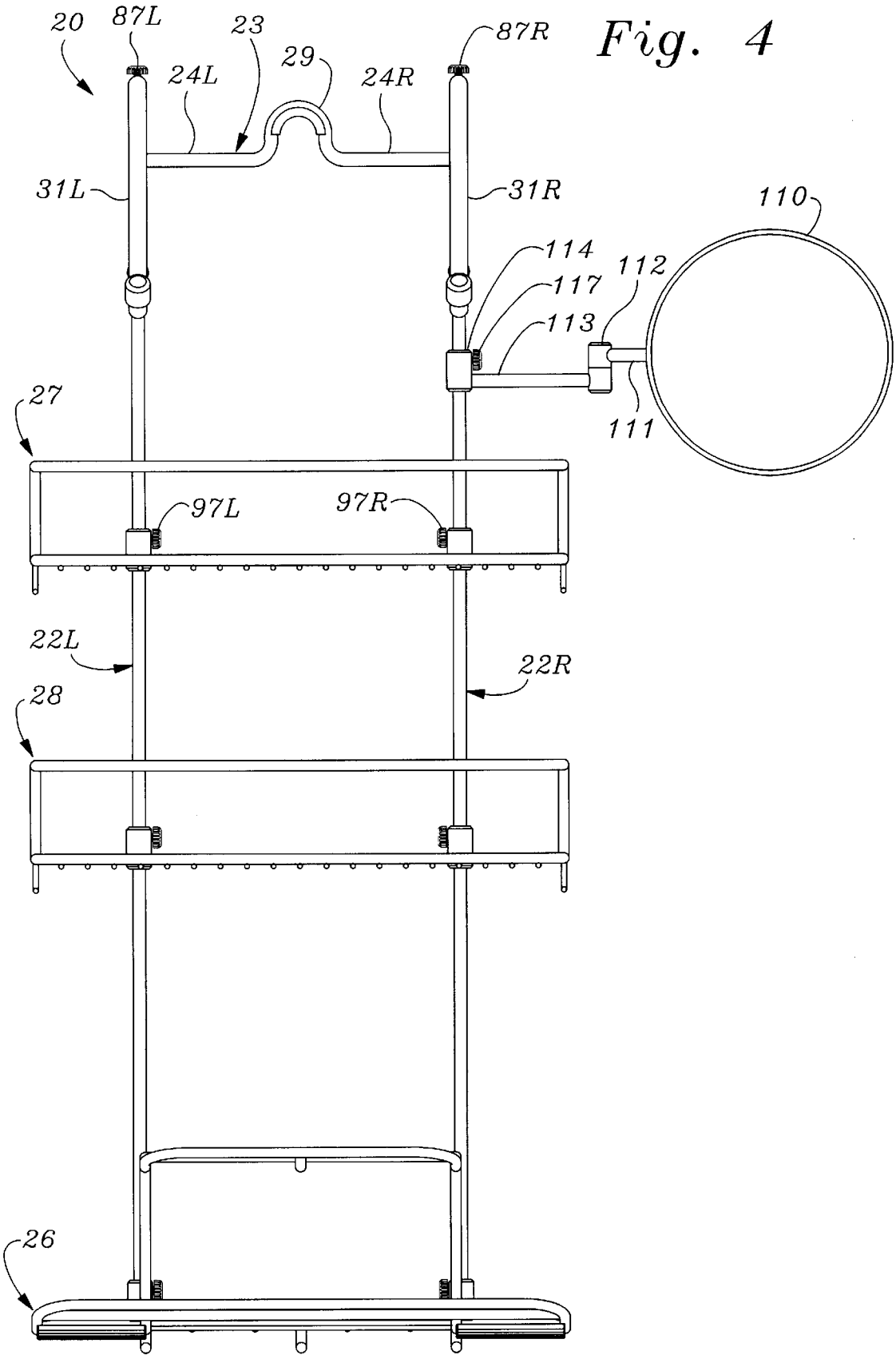
FIG. 4 is a front elevation view of the shower caddy of FIG. 2.

FIG. 3 illustrates a modification of the basic embodiment of a reversible shower caddy shown in FIGS. 1 and 2 and described above. In a modified reversible shower caddy 60 shown in FIG. 3, transverse frame member 23 of the basic embodiment 20, is replaced by a modified transverse frame member 63 which is removably attachable to separate frame stanchions 62L, 62R. This modification allows shower caddy 60 to be disassembled and the component parts thereof to be packaged in a container which is smaller and more convenient for storage and shipping than that required for basic embodiment 20.

Frame 61 of modified reversible shower caddy 60 includes stanchions 62L, 62R which are not permanently attached to upper transverse frame member 63. Aside from that difference, all of the other components of basic embodiment 20 and modification 60 of a reversible shower caddy according to the present invention can be identical. Accordingly, the ensuing detailed description of the structure and functions of modified reversible shower caddy 60 is completely applicable to, and further defines, basic embodiment 20.

Referring now to FIGS. 3–11, in addition to FIGS. 1 and 2, modified reversible shower caddy 60 according to the present invention may be seen to include a frame 61 including two parallel, elongated straight left and right side members or stanchions 62L, 62R. As shown in FIG. 8B, each stanchion 62L, 62R, which is preferably constructed of a rigid, durable material such as 0.31 inch diameter steel rod stock, has a short upper end arm 32L, 32R which protrudes perpendicularly forward from the upper end portion of the rod. End arm 32L, 32R may be conveniently formed by making a right angle bend in the rod stock from which stanchions 62L, 62R are fabricated.

As shown in FIG. 3, modified reversible shower caddy 60 includes an upper transverse frame member 63 which has left and right lateral end portions 64L, 64R, which protrude outwardly from a laterally centrally located, arcuately upwardly curved arch section 69. Arch section 69 has a generally semi-circular shape, and has a radius adapting the arch section to fit over the outer cylindrical surface of a shower head. Desirably, arch section 69 has secured to the concave inner surface 70 thereof an inverted U-shaped pad 71 made of a resilient, non-slip material such as silicone rubber, to promote a non-slip engagement with a shower head pipe. For example, for use with a shower head pipe having a diameter of one inch, pad 71 would have a radius of about 9/16 inch.

Figure 10A:
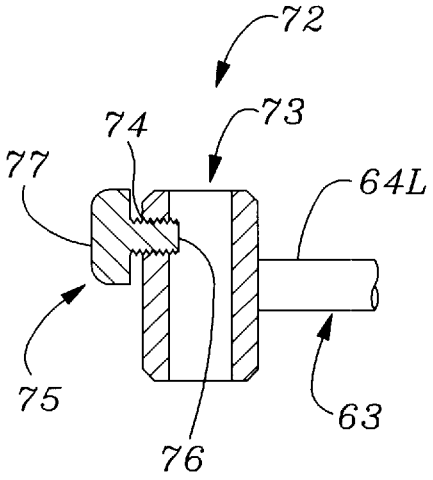
FIG. 10A is a longitudinal sectional view of a slider comprising part of the shower caddy of FIG. 3.
Figure 10B:
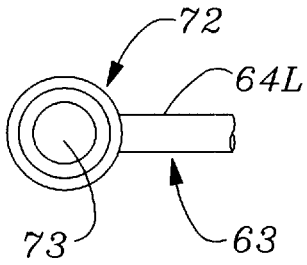
FIG. 10B is an end elevation view of the slider of FIG. 10A.
Figure 10C:
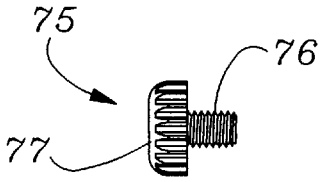
FIG. 10C is a side elevation view of a thumbscrew for use with the hook of FIG. 9 and slider of FIG. 10A.
Figure 10D:
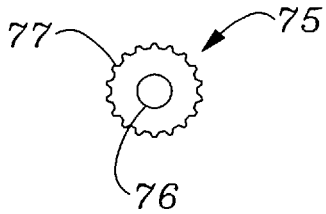
FIG. 10D is an inner end elevation view of the thumbscrew of FIG. 10C.

Referring now to FIGS. 3 and 10A, it may be seen that transverse frame member 63 has attached to outer ends of lateral end portions 64L, 64R thereof a pair of tubular sliders 72L, 72R for attaching opposite ends of the transverse frame member to stanchions 62L, 62R. As shown in FIGS. 10A and 10B, each slider 72L, 72R has a generally cylindrical shape, including a longitudinally disposed, smooth coaxial bore 73 adapted to slidably receive a stanchion rod 62L, 62R. Each slider 72L, 72R has welded to a cylindrical wall surface thereof, perpendicular to the axis of bore 73 a lateral end portion 64L, 64R of transverse frame member 63. Also, each slider 72L, 72R has disposed through an outer cylindrical wall thereof a radially disposed threaded bore 74L, 74R that communicates with smooth bore 73 and which is adapted to receive the threaded shank 76L, 76R of a thumb screw 75L, 75R having a knob 77L, 77R, as shown in FIGS. 10C and 10D. With this construction, lower ends 78L, 78R of stanchions 62L, 62R may be inserted into the upper ends of bores 73L, 73R through sliders 72L, 72R, and the sliders slid upwardly on the stanchion rods to a desired height, below end arms 32L, 32R of the stanchion rods, as shown in FIG. 3. Thus positioned, sliders 72L, 72R may be secured to stanchion rods 62L, 62R by tightening thumb screws 75L, 75R into threaded bores 74L, 74R of the sliders, sufficiently for the ends of shanks 76L, 76R of the screws to bear tightly against the stanchion rods within bores 73L, 73R, through the sliders. Tightening thumb screws 75L, 75R as described secures transverse frame member 63 to stanchion rods 62L, 62R.

Referring now to FIGS. 3 and 9, in addition to FIGS. 1 and 2, it may be seen that modified reversible shower caddy 60, as well as basic embodiment 20 of the reversible shower caddy, preferably utilizes hooks 31L, 31R which are removably and adjustably attached to upper arms 32L, 32R of stanchions 62L, 62R or 22L, 22R.

Thus, as shown in FIG. 9, each hook 31L, 31R is preferably fabricated as a hollow tubular component of uniform transverse cross section, as by bending steel tube stock, for example. With this construction, straight upper end portion 33L, 33R of each hook 31L, 31R has a coaxial bore 80L, 80R of the proper diameter to insertably receive a forward protruding upper arm 32L, 32R of a stanchion rod 62L, 62R or 22L, 22R. As shown in FIG. 9, straight upper end portion 33L, 33R of each hook 31L, 31R has through an upper side thereof a radially disposed, threaded bore 81L, 81R that communicates with smooth bore 80L, 80R and which is adapted to receive threaded shank of thumb screw 87, in a fashion similar to thumb screws 77 received in threaded bores 75L, 75R described above. This construction enables hooks 31L, 31R to be removably attached to arms 32L, 32R of stanchion rods 62L, 62R, or 22L, 22R, with rear vertical faces 38L, 38R of each hook spaced apart at an adjustable distance from the front surface of stanchion rod, thus enabling the width of the opening 40L, 40R to be adjusted to fit shower enclosure panels or doors of various thicknesses.

Figure 5:
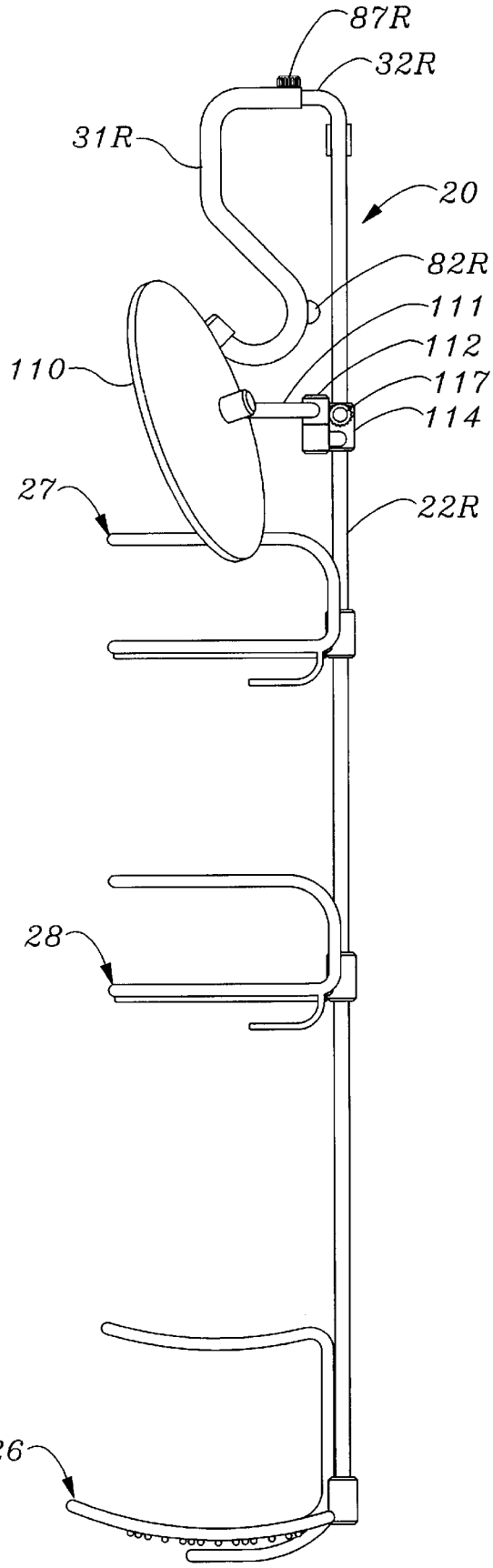
FIG. 5 is a right side elevation view of the shower caddy of FIG. 2.

Each hook 31L, 31R preferably has a cushioned pad 82L, 82R made of a resilient material such as silicone rubber protruding from rear vertical face 38I, 38R of the hook, to minimize the likelihood of scratching or cracking a glass shower panel or door on which the vertical face seats. Thus, as shown in FIG. 9, lower curved portion 36L, 36R of each hook 31L, 31R preferably has formed therein a horizontally forwardly disposed bore 83 which communicates with smooth bore 80 through the hook. Bore 83L, 83R insertably receives an enlarged, smaller inner head of a dumbbell-shaped resilient element having a larger diameter out pad 82L, 82R, the inner head elastically expanding within bore 80L, 80R to secure the pad to hook 31L, 31R, as shown in FIG. 5.

The construction of upper shelf 27, lower shelf 26, and intermediate shelf 28 of reversible shower caddy 20 or 60, and how the shelves are removably and reversibly attached to frame 21 or 61, may be best understood by referring to FIGS. 4–6 and 11 in addition to FIGS. 1 and 2.

Figure 11:
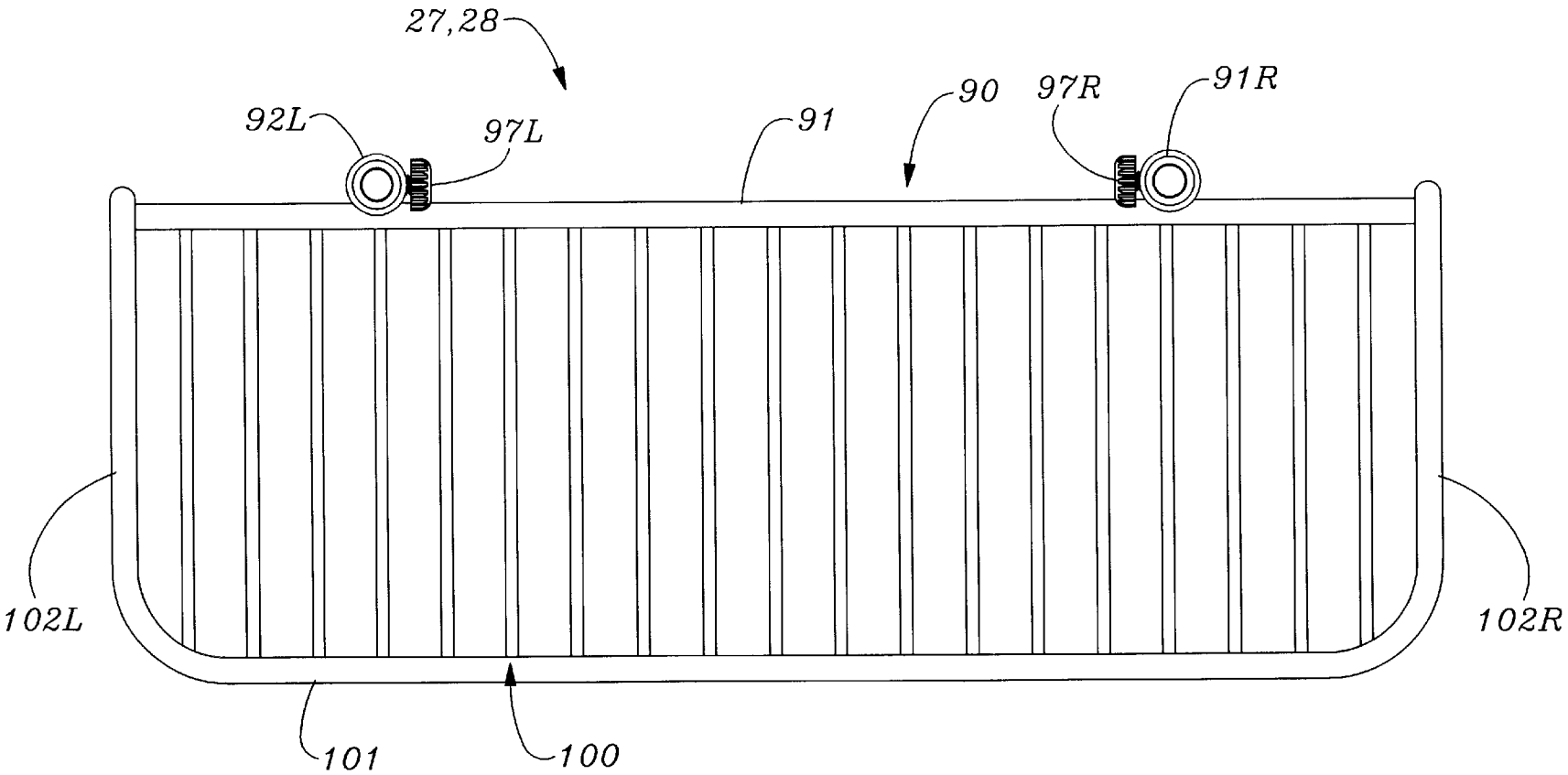
FIG. 11 is an upper plan view of a shelf comprising part of the shower caddy of FIG. 3.

As shown in FIGS. 1-3, upper and intermediate shelves 27 and 28 may be identical in construction, and are substantially similar in construction to lower shelf 26. Thus, each shelf 26, 27, 28 has a base 90 including a laterally disposed rear attachment rod 91. As shown in FIG. 11, each rear attachment rod 91 of shelves 26, 27, 28 has welded laterally inwards of left and right outer lateral ends thereof sliders 92L, 92R, which may be identical in structure and function to sliders 72L, 72R described above and shown in FIGS. 10A and 10B.

Figure 6:
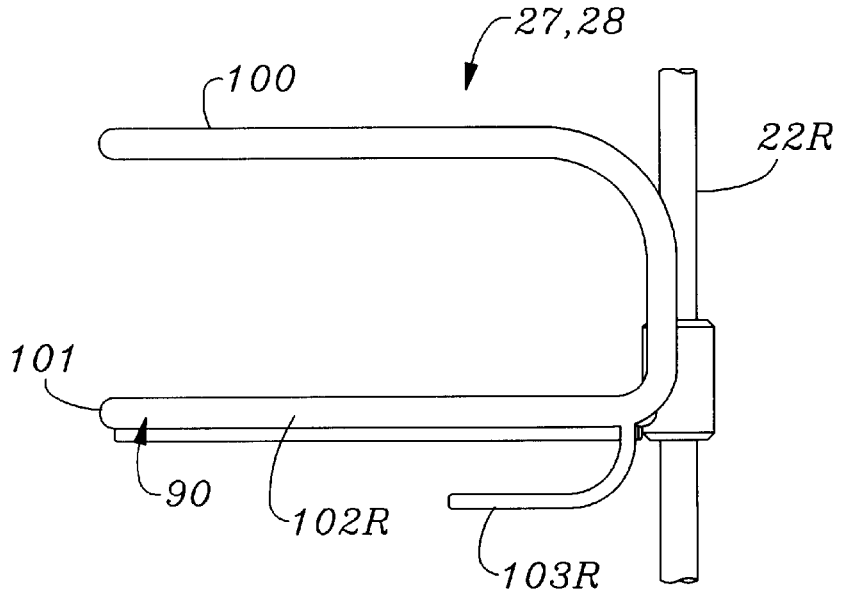
FIG. 6 is a fragmentary right side elevation view of the shower caddies of FIGS. 2 and 3, on an enlarged scale and showing an upper shelf thereof.

As shown in FIGS. 1 and 6, upper and intermediate shelves 27, 28 preferably are provided with a U-shaped article retainer bar 100 located above the front and side legs 101, 102L, 102R of shelf base 90, and which may be fabricated continuously therewith by bending a length of metal rod stock. Preferably, upper and intermediate shelves 27, 28 are also provided with a pair of U-shaped hooks 103L, 103R which protrude forward from beneath rear attachment rod 91, at opposite lateral ends thereof, for supporting wash cloths, brushes, loofas and the like.

Figure 7:
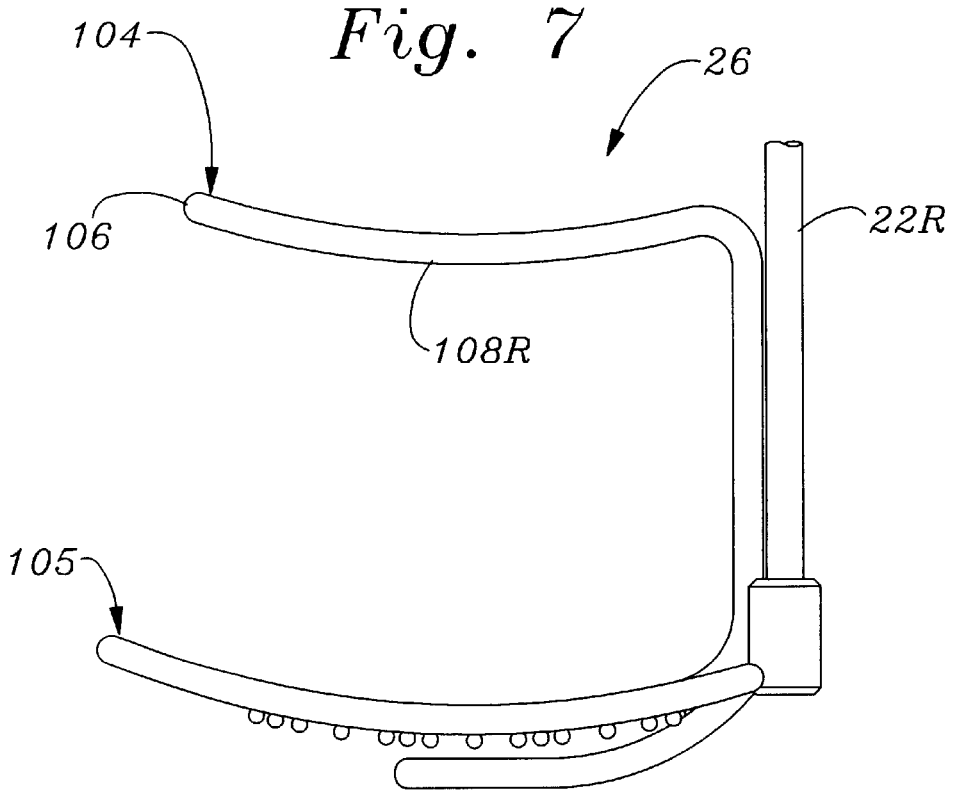
FIG. 7 is a fragmentary right side elevation view of the shower caddies of FIGS. 2 and 3, on an enlarged scale and showing a bottom shelf thereof.

As shown in FIGS. 1, 3, and 7 lower shelf 26 preferably includes a rectangularly-shaped retainer bar structure 104 spaced above base 105 of the shelf, the retainer bar structure having a front laterally disposed member 106, a rear laterally disposed member 107, left and right side members 108L, 108R, and a center longitudinally disposed member 109, forming a pair of laterally adjacent openings on either side thereof for receiving containers, e.g., of shampoo and conditioner.

Referring to FIGS. 1–3, it may be seen that shower caddy 20 or 60 is desirably provided with a mirror 110 mounted on the end of outer arm 111 connected by a swivel joint 112 to an inner arm 113. The latter in turn is connected to either a left or right stanchion, i.e., 22L, 22R or 62L, 62R by a slider 114 identical in structure and function to slider 72 described above, the slider being secured to a stanchion by a thumbscrew 117.

What is claimed is:

1. A shower caddy for holding items usable in a bathroom shower which includes a shower head and an enclosure, said caddy comprising;

f. a frame including a pair of laterally spaced apart upright side members, g. an upper transverse bracket member disposed transversely between said side members, near upper ends thereof, h. first hanger means attached to said frame for hanging said caddy onto a shower head, said first hanger means comprising a laterally centrally located arch section in said upper transverse bracket member, said arch section having an upwardly concave opening adapted to fit over a shower head pipe and suspend said frame therefrom, i. second hanger means attached to said frame for hanging said caddy from a shower enclosure panel, and j. at least a first shelf disposed transversely to said side members and attached thereto, said shelf being removable and alternatively attachable to front and rear sides of said frame.

2. The caddy of claim 1 wherein said second hanger means is further defined as comprising a first hanger hook protruding forward from a front side of said frame, at a location proximate to an upper end thereof, said hanger hook having a downwardly depending portion spaced forward from a frame member to form therebetween an upwardly facing opening adapted to insertably receive a shower enclosure panel, and an upper horizontal portion for resting on the upper transverse edge wall of said enclosure panel, whereby said shelf may be attached to a rear side of said frame, and said hook engaged in said enclosure panel to hang said caddy thereon.

3. The caddy of claim 2 wherein said upper transverse bracket member is removably attachable to said side members of said frame.

4. The caddy of claim 1 wherein said second hanger means is further defined as comprising in combination a pair of hanger hooks protruding forward from a front side of said frame, said hanger hooks spaced equal distances laterally outwards from a laterally centered vertical center line of said frame, each of said hanger hooks having an upper portion which protrudes forward from said frame, and a downwardly depending portion including an angled portion which angles downwardly and rearwardly towards a front surface of said frame, said angled portion having a lower end portion spaced forward from a frame member to form therebetween an upwardly facing opening adapted to insertably receive a shower enclosure panel, with lower surfaces of said upper portions of said hanger hooks resting on an upper transverse edge wall of said enclosure panel to thereby suspend said caddy from said panel.

5. The caddy of claim 4 wherein a separate one of said pair of hanger hooks protrudes from a separate one of each of said pair of side members.

6. The caddy of claim 5 wherein of said pair of side members is further defined as having a relatively long, straight lower portion and a relatively short upper end portion angled perpendicularly forward from said lower portion to form an arm.

7. The caddy of claim 6 wherein each of said pair of hanger hooks is attached to a separate one of said arms.

8. The caddy of claim 6 wherein each of said pair of hanger hooks is removably attached to a separate one of said arms.

9. The caddy of claim 6 wherein each of said pair of hanger hooks is removably attachable to a separate one of said arms with said lower end portion of said hook spaced forward from said frame side member at an adjustable distance.

10. A shower caddy for holding items usable in a bathroom shower which includes a shower head and an enclosure, said caddy comprising;

a. a frame including a pair of laterally spaced apart stanchions, said stanchions each having a relatively long, generally straight lower portion and a relatively short, generally straight upper arm protruding forward of said frame, b. an upper transverse bracket member disposed transversely between said stanchions and having a pair of laterally opposed end portions attached thereto proximate said upper arms of said stanchions, said bracket member having a laterally centrally located arch section provided with an upwardly concave opening adapted to fit over a shower head pipe and suspend said frame therefrom, c. at least a first, upper shelf, d. means for removably attaching said first, upper shelf near opposite lateral ends thereof to said stanchions reversibly on said front and rear sides with a generally horizontal upper surface of said shelf disposed perpendicularly outwardly from said stanchions, and e. a pair of laterally opposed hooks for suspending said frame from a shower enclosure panel, said hanger hooks protruding forward from said upper end arms of said stanchions, each of said hooks having a generally straight upper end portion attached to said upper end arm of said stanchion, and an outer portion which depends downwardly from an outer end of said upper inner end portion, said outer portion including a downwardly depending portion having an angled portion which angles downwardly and rearwardly towards a front surface of said stanchion, said angled portion having a lower end portion spaced forward from said stanchion to form therebetween an upwardly facing opening adapted to insertably receive a shower enclosure panel with a lower surface of said upper inner end portion of said hook resting on an upper transverse edge wall of said enclosure panel to thereby suspend said caddy from said panel.

11. The shower caddy of claim 10 wherein each of said hanger hooks is removably attachable to a separate one of said arms with said lower end portion of said hook spaced forward from said stanchion at an adjustable distance.

12. The caddy of claim 10 wherein each of said hanger hooks is removably attachable to said stanchion arms by means of a telescopic joint between said arm and said straight upper end portion of said hanger hook.

13. The caddy of claim 10 wherein said upper transverse bracket member is removably attachable to said stanchions.

14. The caddy of claim 10 wherein said means for removably attaching said first, upper shelf to said stanchions is further defined as comprising in combination a pair of laterally opposed sliders fastened to a rear portion of said shelf means opposite lateral ends thereof, said sliders having parallel, vertically disposed smooth bores adapted to slidably receive said lower portions of said stanchions, each of said sliders including means for securing said slider to said stanchion at an adjustable height.

15. The caddy of claim 10 further including means for removably attaching said upper transverse bracket member to said stanchions, said means comprising in combination a pair of laterally opposed sliders fastened to opposite lateral ends of said laterally opposed end portions of said upper transverse bracket member, said sliders having parallel, vertically disposed smooth bores adapted to slidably receive said lower portions of said stanchions, each of said sliders including means for securing said slider to said stanchion at an adjustable height.

16. The caddy of claim 10 further including a mirror adjustably mounted to a stanchion of said frame.

* * * * *